US007477854B2

(12) United States Patent
Nakazawa et al.

(10) Patent No.: US 7,477,854 B2
(45) Date of Patent: Jan. 13, 2009

(54) IMAGE FORMING APPARATUS AND CONTROL METHOD FOR IMAGE FORMING APPARATUS

(75) Inventors: Yoshiki Nakazawa, Toyokawa (JP); Kunio Furukawa, Toyokawa (JP); Masahiro Kamiya, Toyohashi (JP); Shigeki Nozawa, Hoi-gun (JP); Masazumi Ito, Toyohashi (JP); Satoshi Hasegawa, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 89 days.

(21) Appl. No.: 11/602,388

(22) Filed: Nov. 21, 2006

(65) Prior Publication Data

US 2007/0201883 A1 Aug. 30, 2007

(30) Foreign Application Priority Data

Feb. 28, 2006 (JP) ..... 2006-053219
Sep. 26, 2006 (JP) ..... 2006-259861

(51) Int. Cl.
*G03G 15/00* (2006.01)
*G03G 15/08* (2006.01)

(52) U.S. Cl. ..... 399/12; 399/27

(58) Field of Classification Search ..... 399/12, 399/13, 25, 27, 111, 112, 119, 120, 262
See application file for complete search history.

(56) References Cited

U.S. PATENT DOCUMENTS 6,658,219 B1 * 12/2003 Ito et al. ..... 399/27
2002/0143893 A1 * 10/2002 Nakazono et al. ..... 709/217
2004/0253007 A1 * 12/2004 Ikeda et al. ..... 399/12
2005/0286913 A1 * 12/2005 Adkins et al. ..... 399/12

FOREIGN PATENT DOCUMENTS

| | | |
|---|---|---|
| JP | 04-084170 | 3/1992 |
| JP | 2004-341283 A | 12/2004 |
| JP | 2005-326729 | 11/2005 |

OTHER PUBLICATIONS

Japanese Office Action, Notice of Reasons for Refusal dated Oct. 3, 2008 in No. Tokugan 2006-259861 w/English Translation.

* cited by examiner

*Primary Examiner*—Sophia S Chen
(74) *Attorney, Agent, or Firm*—Buchanan Ingersoll & Rooney PC

(57) ABSTRACT

An image forming apparatus includes a cartridge loading portion removably loaded with a first cartridge containing therein a consumable but carrying no memory storing information on the consumable, or with a second cartridge containing therein the consumable and carrying a memory storing information on the consumable; a controller; and a first memory storing the information on the consumable contained in the first cartridge, and is characterized in that the controller includes: a first consumption calculating/storing portion operating when the first cartridge is loaded in the cartridge loading portion, calculating a consumption of the consumable in the first cartridge and storing the calculation result in the first memory; and a second consumption calculating/storing portion for calculating a consumable consumption of the second cartridge and for storing the calculation result in the memory installed in the second cartridge.

16 Claims, 6 Drawing Sheets

IMAGE FORMING APPARATUS AND CONTROL METHOD FOR IMAGE FORMING APPARATUS

RELATED APPLICATION

This application is based on applications No. 53219/2006 and No. 259861/2006 filed in Japan, the contents of which are hereby incorporated by reference.

BACKGROUND OF THE INVENTION

1. Field of the Invention

The present invention relates to an image forming apparatus such as copiers and printers. More particularly, the invention relates to an image forming apparatus wherein a variety of cartridges containing therein various consumables, such as an imaging cartridge containing a toner, are removably loaded in an apparatus body.

2. Description of the Related Art

Conventionally, the image forming apparatuses such as the copiers and printers employ the various cartridges containing therein a variety of consumables, such as the imaging cartridge containing the toner. Such cartridges are removably loaded in the apparatus body.

When the various cartridges such as the imaging cartridge are replaced, such an image forming apparatus must take a procedure for determining the type and status of the cartridge to be replaced so as to make sure that a proper cartridge is loaded in the apparatus body. The determination is made on, for example, the color of the toner contained in the cartridge, the toner content, information on the replacement product, consumption information and the like. To meet this purpose, a constitution is made, for example, such that the cartridge and a cartridge mounting portion of the image forming apparatus are configured to conform to each other to permit only a proper cartridge to be loaded. Otherwise, the cartridge is provided with a fuse for determining whether the replacement cartridge is a fresh product or not.

However, if the aforementioned determination mechanism is provided in all types of cartridges, an increased cost results.

In order to provide for a low-cost determination of the types of all the cartridges, it has become a practice to install a memory in every one of the cartridges and to write cartridge-specific information in the memory at factory shipment, the information indicating the type and specifications of the cartridge. In this connection, an image forming apparatus operating as follows has been proposed. When this cartridge is loaded in the image forming apparatus, the apparatus retrieves the information written in this memory so as to determine the type of the cartridge and then, performs an operation suited to the type of the cartridge.

However, the measure to install the memories in all the cartridges still involves the problem of cost increase.

More recently, an image forming apparatus directed to the cost reduction of a photosensitive cartridge has been proposed (Japanese Unexamined Patent Publication No. 2004-341283). In this apparatus, consumption information on a photosensitive member is stored in the imaging cartridge instead of installing the memory in the photosensitive cartridge accommodating the photosensitive member, and determination is made on the life end of the photosensitive member.

However, in a case where there are plural imaging cartridges individually containing toners of different colors in different quantities, for example, it is necessary to prevent the individual cartridges from being mistakenly loaded in improper places.

Furthermore, the replacement of the aforementioned cartridges may involve the following problem. That is, a new replacement cartridge may be subjected to various improvements. In some cases, the characteristic or the like of the toner contained in the replacement cartridge may be subjected to some minor change such as to permit an alternative image forming apparatus to share the cartridge and hence, the toner contained in the replacement cartridge at factory shipment may have a slightly varied characteristic from that of the toner contained in the in-use cartridge.

In a case where such a new cartridge containing therein the toner having somewhat varied characteristic is loaded in the image forming apparatus, the apparatus must be controlled according to the varied characteristic of the toner.

On this account, all the cartridges such as the above imaging cartridge normally carry the memories which store the characteristic of the toner contained in the cartridge and such, thereby permitting the image forming apparatus to perform image formation under proper image forming conditions. Consequently, the problem of the increased cost of the cartridge still remains unsolved.

SUMMARY OF THE INVENTION

An object of the invention is to provide an image forming apparatus arranged to be removably loaded with a variety of cartridges containing therein various types of consumables, such as an imaging cartridge containing therein a toner, the apparatus which is adapted to perform proper image formation although all the cartridges do not carry memories.

An image forming apparatus according to the invention comprises: a cartridge loading portion removably loaded with a first cartridge containing therein a consumable but carrying no memory storing information on the consumable, or with a second cartridge containing therein the consumable and carrying a memory storing information on the consumable; a controller; and a first memory for storing the information on the consumable contained in the first cartridge, wherein the controller includes: a determination portion for determining whether a cartridge loaded in the cartridge loading portion is the first cartridge or the second cartridge; a first consumption calculating/storing portion operating when the first cartridge is loaded in the cartridge loading portion, calculating a consumption of the consumable in the first cartridge and storing the calculation result in the first memory; a life-end storing portion for detecting the life end of the first cartridge based on the consumable consumption of the first cartridge calculated by the first consumption calculating/storing portion, and for storing the life-end information on the first cartridge in the first memory; and a second consumption calculating/storing portion for calculating a consumption of the consumable in the second cartridge and storing the calculation result in the memory installed in the second cartridge.

A control method for an image forming apparatus removably loaded with a cartridge containing therein a consumable, comprises: a step of determining whether the loaded cartridge is a first cartridge containing therein a consumable but not carrying a memory storing information on the consumable or a second cartridge containing therein the consumable and carrying a memory storing the information on the consumable; a step of calculating a consumption of the consumable in the first cartridge and storing the calculation result in a first memory provided in the image forming apparatus in a case where the loaded cartridge is the first cartridge; a step of storing life-end information on the first cartridge in the first memory when the first cartridge is determined to reach its life end based on the consumable consumption of the first cartridge in the case where the loaded cartridge is the first cartridge; and a step of calculating a consumption of the consumable in the second cartridge and storing the calculation result in the memory installed in the second cartridge in a case where the loaded cartridge is the second cartridge.

In the image forming apparatus and the control method according to the invention, the cartridge containing therein the consumables is removably loaded in the apparatus body in the following manner. At first, the first cartridge not carrying the memory storing the consumable information is loaded in the cartridge loading portion and the consumable information on the first cartridge is stored in the first memory. Then, the consumption of the consumable contained in the first cartridge is calculated by the first consumption calculating/storing portion provided in the controller and is stored in the first memory.

Such a constitution permits the apparatus to perform the proper image formation by initially using the first cartridge without the memory storing the consumable information. Thus, the apparatus may achieve the cost reduction by employing a reduced number of memories.

The following advantage may be obtained by storing image formation information used for image formation in the memory installed in the second cartridge. Even in a case where the characteristic of the consumable contained in the second cartridge is varied from that of the consumable contained in the first cartridge, the apparatus is capable of performing the proper image formation based on the image formation information stored in the memory of the second cartridge.

These and other objects, advantages and features of the invention will become apparent from the following description taken in conjunction with the accompanying drawings which illustrate a specific embodiment of the invention.

DESCRIPTION OF THE PREFERRED EMBODIMENT

An image forming apparatus according to an embodiment of the invention will be specifically described with reference to the accompanying drawings. It is to be noted that the image forming apparatus according to the invention is not limited to that illustrated by the following embodiment and may be modified as needed so long as such a modification does not depart from the scope of the invention.

Figure 1:
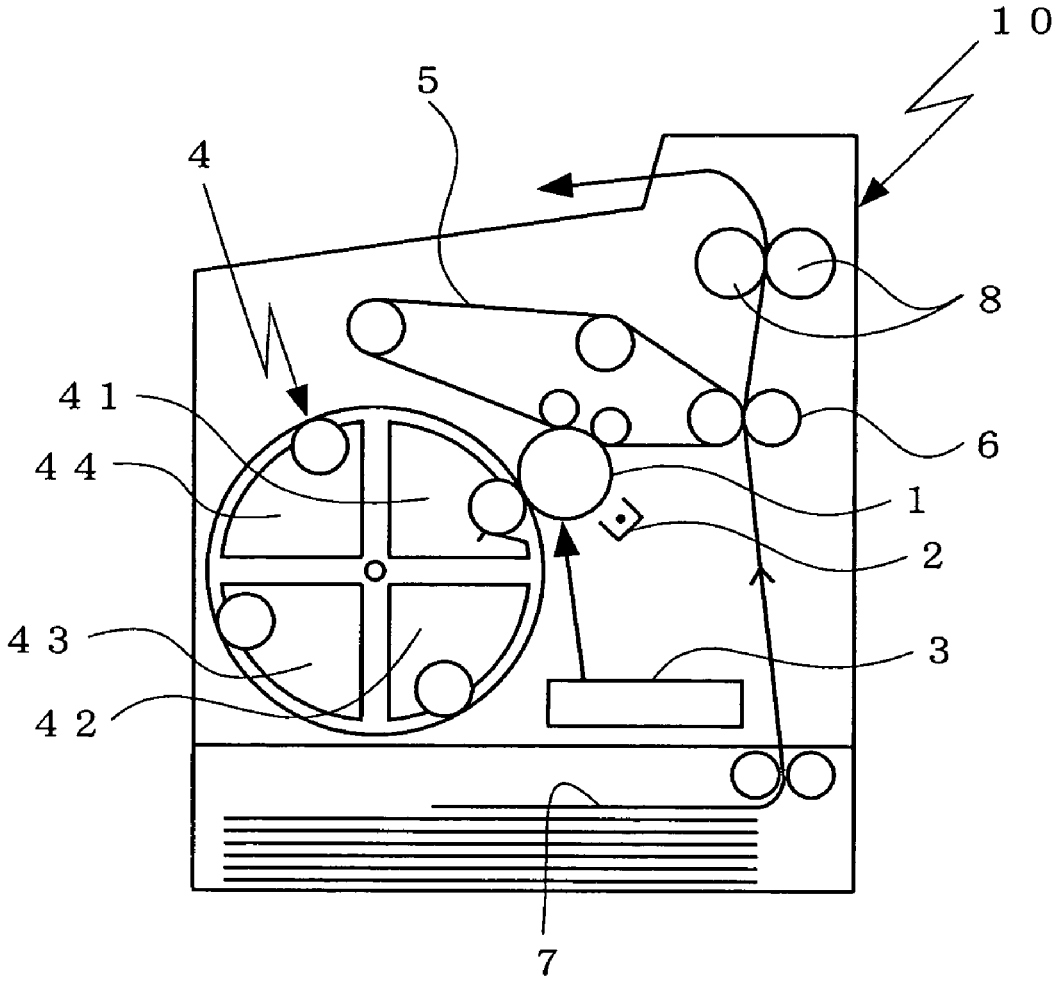
FIG. 1 is a schematic diagram explanatory of an image forming apparatus according to one embodiment of the invention.

The image forming apparatus of the embodiment operates as follows. As shown in FIG. 1, a drum-shaped image carrier 1 disposed in an apparatus body 10 is rotated while a surface of the image carrier 1 is electrically charged by a charger 2. Subsequently, an exposure unit 3 irradiates light on the charged image carrier 1 according to an image signal, thereby forming an electrostatic latent image on the image carrier surface 1.

The image forming apparatus of the embodiment employs a rotary-type development unit 4 retaining four imaging cartridges 41 to 44 individually containing therein toners of different colors which include yellow, magenta, cyan and black.

The rotary-type development unit 4 is rotated for sequentially positioning the individual imaging cartridges 41 to 44 to a position opposite the above image carrier 1. The imaging cartridges 41 to 44 sequentially supply the toners of the respective colors to the image carrier 1 to develop the latent images into toner images. The individual toner images thus formed on the image carrier 1 are sequentially transferred to an intermediate transfer belt 5, so as to form a full-colored toner image on the intermediate transfer belt 5. Subsequently, a transfer unit 6 transfers the full-colored toner image from the intermediate transfer belt 5 to a recording sheet 7 such as recording paper. The full-colored toner image so transferred is fixed to the recording sheet 7 by means of a fixing unit 8.

The image forming apparatus initially uses, as the aforesaid four imaging cartridges 41 to 44, four first imaging cartridges 41*a* to 44*a* which are not provided with memories but provided with cartridge detection boards 45*a* to 45*d*.

A first memory 30 disposed in the apparatus body 10 stores toner-related information items such as toner quantities, toner characteristics, life ends and the like of the toners contained in the four first imaging cartridges 41*a* to 44*a* without the memories, as well as various image-formation information items which include: development conditions under which the electrostatic latent images formed on the above image carrier 1 are developed; light exposure conditions under which the electrostatic latent images are formed on the image carrier surface 1 by means of the exposure unit 3; and the like.

The first memory 30 is adapted to communicate with a controller 20 disposed in the apparatus body 10 by means of first communications means 51. The first imaging cartridges 41*a* to 44*a* are connected to the controller 20 via respective contact points 46*a* to 46*d*, so that the respective cartridge detection boards 45*a* to 45*d* of the first imaging cartridges 41*a* to 44*a* communicate with the controller 20 by means of second communications means 52.

While the first communications means 51 responsible for the communications between the first memory 30 and the controller 20 may preferably be connected by way of a serial communication line in the light of reducing the number of signals, the communication means may also be connected by way of bus connection.

When the controller 20 communicates with the cartridge detection boards 45*a* to 45*d* disposed in the first imaging cartridges 41*a* to 44*a* by means of the second communications means 52, the controller 20 sends transmission data. In a case where the first imaging cartridges 41*a* to 44*a* are loaded, the transmission data are directly inputted as a reception data signal. On the other hand, in a case where the first imaging cartridges 41*a* to 44*a* are not loaded, the reception data signal is not inputted. The controller detects the loading of the first imaging cartridges 41*a* to 44*a* based on whether the reception data signal is inputted or not.

Figure 3:
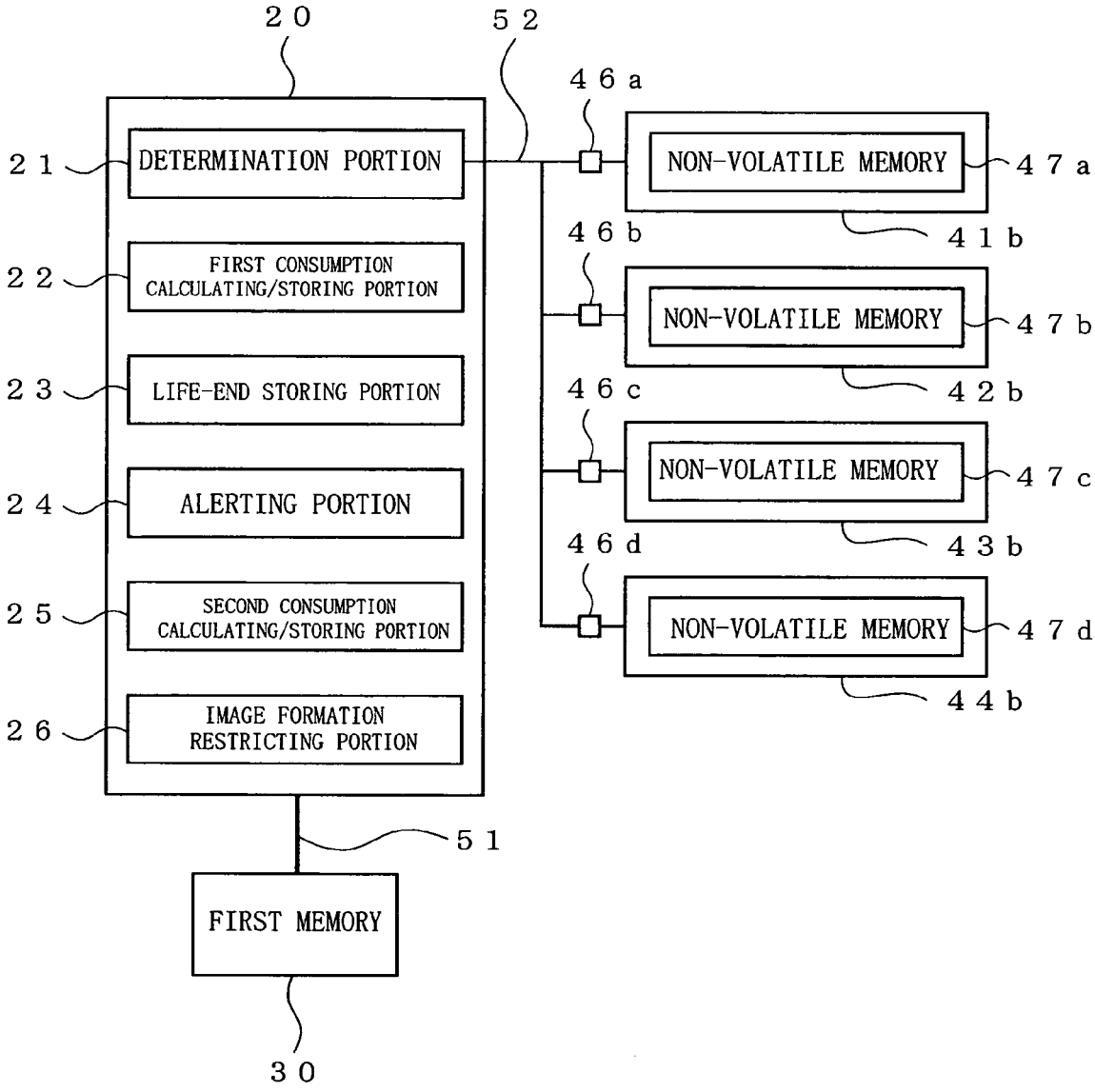
FIG. 3 is a block diagram showing a relation between four second imaging cartridges carrying memories, and the first memory and the controller which are provided in the apparatus body of the image forming apparatus according to the above embodiment.

In a case where the image forming apparatus has used up the toners in the first imaging cartridges 41*a* to 44*a* so that the imaging cartridges come to the end of their lives, the controller takes an action such that the first imaging cartridges 41*a* to 44*a* are sequentially replaced by second imaging cartridges 41*b* to 44*b* carrying memories 47*a* to 47*d*, as shown in FIG. 3. The second imaging cartridges 41*b* to 44*b* are also connected to the above controller 20 via the respective contact points 46*a* to 46*d* thereof, so that the controller 20 may communicate with the respective memories 47*a* to 47*d* of the second imaging cartridges 41*b* to 44*b* by means of the second communications means 52.

It is noted here that the memories 47*a* to 47*d* of the second imaging cartridges 41*b* to 44*b* each store: the toner-related information such as the toner quantity and the characteristic of the toner contained in each of the second imaging cartridges 41*b* to 44*b*; and the various image-formation information items which include the development conditions under which the electrostatic latent images formed on the image carrier 1 are developed; the exposure conditions under which the exposure unit 3 forms the electrostatic latent images on the image carrier surface 1; and the like.

It is also preferred that the second communications means 52 responsible for the communications between the memories 47*a* to 47*d* of the second imaging cartridges 41*b* to 44*b* and the controller 20 is connected to the controller by way of the serial communication line in the light of reducing the number of signals.

Figure 2:
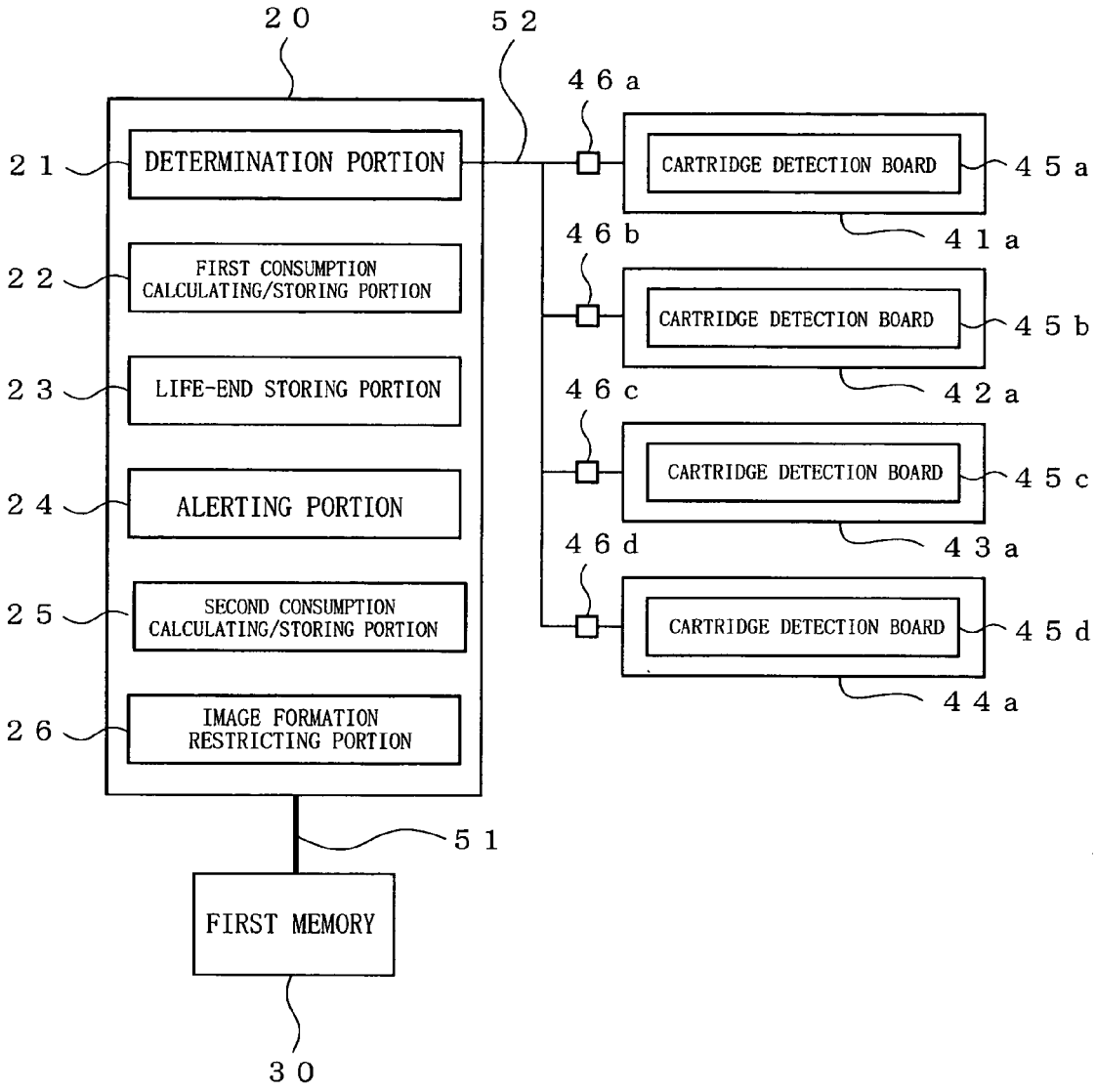
FIG. 2 is a block diagram showing a relation between four first imaging cartridges carrying no memory, and a first memory and a controller which are provided in an apparatus body of the image forming apparatus according to the above embodiment.

As shown in FIG. 2 and FIG. 3, the above controller 20 includes: a determination portion 21; a first consumption calculating/storing portion 22; a life-end storing portion 23; an alerting portion 24; a second consumption calculating/storing portion 25; and an image formation restricting portion 26.

The determination portion 21 uses the above second communications means 52 for determining on the existence of the memories 47*a* to 47*d* of the imaging cartridges 41 to 44.

The first consumption calculating/storing portion 22 calculates a consumption of the toner in each of the above first imaging cartridges 41*a* to 44*a* and sends the calculation results to the first memory 30 for storage, by way of the first communications means 51. That is, the apparatus is in a first management mode to commit information related to consumables, such as the toners in the individual first imaging cartridges 41*a* to 44*a*, to storage in the first memory 30 and to provide the management of the first imaging cartridges based on the information so stored.

The life-end storing portion 23 detects the depletion of the toner in each of the above first imaging cartridges 41*a* to 44*a* based on the calculation results given by the first consumption calculating/storing portion 22. Then, the life-end storing portion sends the detection result to the first memory 30 by way of the first communications means 51 and stores therein the detection result by setting a life-end flag to 1, the life-end flag associated with any one of the first imaging cartridges 41*a* to 44*a* that has depleted the toner.

The alerting portion 24 issues an alert such that any one of the first imaging cartridges 41*a* to 44*a* that has its life-end flag set to 1 in conjunction with the detection of its life end may be replaced with a corresponding one of the second imaging cartridges 41*b* to 44*b* carrying the memories 47*a* to 47*d*.

The second consumption calculating/storing portion 25 calculates a consumption of the toner contained in each of the second imaging cartridges 41*b* to 44*b* as the replacements so loaded according to the alert issued from the alerting portion 24. The second consumption calculating/storing portion sends the calculation results to the respective memories 47*a* to 47*d* of the second imaging cartridges 41*b* to 44*b* via the second communications means 52, so as to store the calculation results in the memories. That is, the apparatus is in a second management mode to commit information related to consumables, such as the toners in the individual second imaging cartridges 41*b* to 44*b*, to storage in the respective memories 47*a* to 47*d* thereof and to provide the management of the second imaging cartridges based on the information so stored.

The image formation restricting portion 26 operates to restrict an image forming operation in a case where a replacement imaging-cartridge so loaded based on the alert issued from the alerting portion 24 is an improper one.

Next, a main operation preceding the image formation performed by the above image forming apparatus is described with reference to a flow chart shown in FIG. 4.

When the image forming apparatus is actuated at power on, the apparatus first performs an image-formation initial operation which includes: checking of the closure of a cover, checking for jam, warm up, checking of the driving operation and the like (Step S1).

In the subsequent Step S2, the detection of the imaging cartridges and the determination of the cartridge types are performed. The detection of the imaging cartridges and the determination of the cartridge types in Step S2 are performed according to a subroutine shown in FIG. 5. A detailed description on this subroutine will be made hereinlater.

Step S3 is performed based on the results of the above Step S2 so as to determine on an error of loading the imaging cartridge. In a case where an imaging-cartridge loading error flag is 1 thus indicating a loading error, the operation flow proceeds to Step S4 where the image formation restricting portion restricts the image formation and provides an error indication. In a case where there is no imaging-cartridge loading error, the operation flow proceeds to Step S5 to check a residual toner quantity of each of the imaging cartridges.

If it is determined in Step S5 that the residual toner quantity is insufficient, the operation flow proceeds to step S4 to provide the error indication. On the other hand, if it is determined that the residual toner quantity is sufficient, the operation flow proceeds to Step S6 where an image-formation stabilizing operation is performed based on the various image-formation information items stored in the aforesaid first memory or the memories installed in the second imaging cartridges.

In the subsequent Step S7, the image forming operation is performed based on a print command and then, toner information such as the residual toner quantity after the image forming operation is updated and re-stored in the first memory or the memories installed in the second imaging cartridges. The image forming operation and the updating/re-storing of the toner information are performed according to a subroutine shown in FIG. 6. A detailed description on this subroutine will be made hereinlater.

Next, the subroutine for detecting the imaging cartridges and determining the cartridge types in the aforesaid Step S2 is described with reference to a flow chart shown in FIG. 5.

The detection of the imaging cartridges and the determination of the cartridge types are performed as follows. In Step S21, determination is first made as to whether or not the life-end flag for the first imaging cartridge, as stored in the first memory, is 0 thus indicating that the first imaging cartridge does not reach the life end.

In a case where the life-end storing portion does not commit the life end of the first imaging cartridge to storage at the first memory so that the life-end flag is 0, the operation flow proceeds to Step S22 where the controller communicates with the cartridge detection board installed in the first imaging cartridge by way of the second communications means 52, so as to determine whether the first imaging cartridge is loaded or not.

If it is confirmed that the first imaging cartridges are loaded, the operation flow proceeds to Step S23 to retrieve data on the residual quantities of the consumables related to the first imaging cartridges, which data are stored in the first memory. That is, the first imaging cartridges are managed in the first management mode. The data on the residual quantity of the consumable include the number of remaining sheets to be subjected to the image formation, the residual toner quantity and the like.

If it is determined in Step S21 that the life-end flag for the first imaging cartridge, as stored in the first memory, is set to 1 thus indicating that the first imaging cartridge reaches the end of its life, or if the loading of the first imaging cartridge is not detected in Step S22, the operation flow proceeds to Step S24 where the controller communicates with the memory of the imaging cartridge by way of the second communications means in order to detect the loading of the second imaging cartridge carrying the memory. In the case where the loading of the first imaging cartridge is not detected in Step S22, the controller also communicates with the imaging cartridge by means of the second communications means for the following reason. That is, there may also be a possible case where the first imaging cartridge is replaced by the second imaging cartridge before the life end of the first imaging cartridge is stored, so that the life-end flag stays at 0.

In step S25, the above communications are carried out to determine on the loading of the second imaging cartridge. In a case where the controller is able to communicate with the memory of the second imaging cartridge, so as to detect the loading of the second imaging cartridge, the operation flow proceeds to Step S26 to retrieve the various information items, such as the toner-related information, stored in the memory installed in the second imaging cartridge. That is, the second imaging cartridges are managed in the second management mode.

On the other hand, in a case where the controller is unable to communicate with the memory of the second imaging cartridge, so as not to detect the loading of the second imaging cartridge, the operation flow proceeds to Step S27 where the controller determines the occurrence of the loading error of the imaging cartridge and sets the aforesaid imaging-cartridge loading error flag to 1. In Step S4 shown in FIG. 4, on the other hand, the controller directs the aforesaid image formation restricting portion to provide the error indication.

In Step S28, determination is made as to whether or not the aforementioned determination operations are done on all the imaging cartridges loaded in the image forming apparatus. If not, the operation flow proceeds to Step S29 where the imaging cartridges are shifted to repeat the aforementioned determination operations on the succeeding imaging cartridge. In this manner, the aforementioned determination operations are repeated till the determinations are made on all the imaging cartridges.

Figure 5:
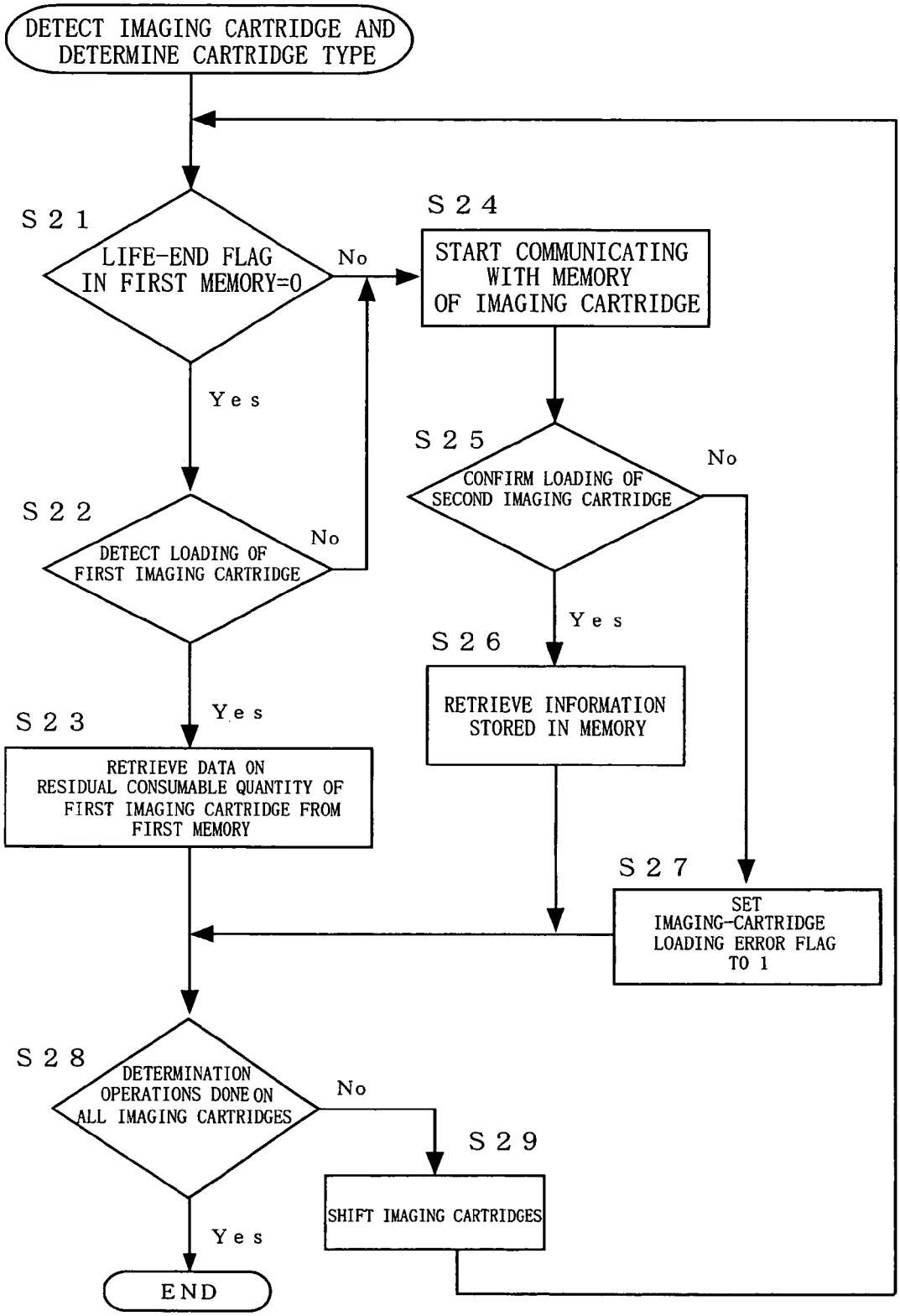
FIG. 5 is a flow chart showing the steps of a subroutine for detecting an imaging cartridge and determining the type of the imaging cartridge, the subroutine executed in the image forming apparatus according to the above embodiment.

In the aforementioned case where the first imaging cartridge having the life-end flag set to 0 is replaced by the second imaging cartridge before the life end of the first imaging cartridge is stored in the memory and thereafter, this first imaging cartridge is loaded again to be used, the apparatus may perform the detection of imaging cartridge and the determination of cartridge type according to the flow chart shown in FIG. 5.

On the other hand, in a case where a first imaging cartridge without a non-volatile memory is mistakenly loaded as a replacement for the first imaging cartridge which has reached the end of its life as indicated by the life-end flag switched to 1 and which should be replaced by the second imaging cartridge carrying the non-volatile memory, or where the first imaging cartridge without the non-volatile memory is mistakenly loaded in the middle of the use of the second imaging cartridge or at the replacement of the second imaging cartridge, the apparatus is unable to retrieve the various information items on the mistakenly-loaded first imaging cartridge from any of the non-volatile memories.

In this case, therefore, the following constitution, the illustration of which is omitted, may be made for example. When the life-end flag for an initial first imaging cartridge is switched to 1, a use-restriction flag for restricting the use of the first imaging cartridge is set to 1. If an alternative first imaging cartridge without the non-volatile memory is loaded in the state where the use-restriction flag is set to 1, the imaging-cartridge loading error flag is set to 1 so as to cause the aforesaid image formation restricting portion to provide the error indication.

In order to permit the image formation even in the above case where the first imaging cartridge without the non-volatile memory is mistakenly loaded, a constitution may also be made such that the above image formation restricting portion performs an image stabilizing operation for adjusting image density, image formation position and cleaning.

Figure 6:
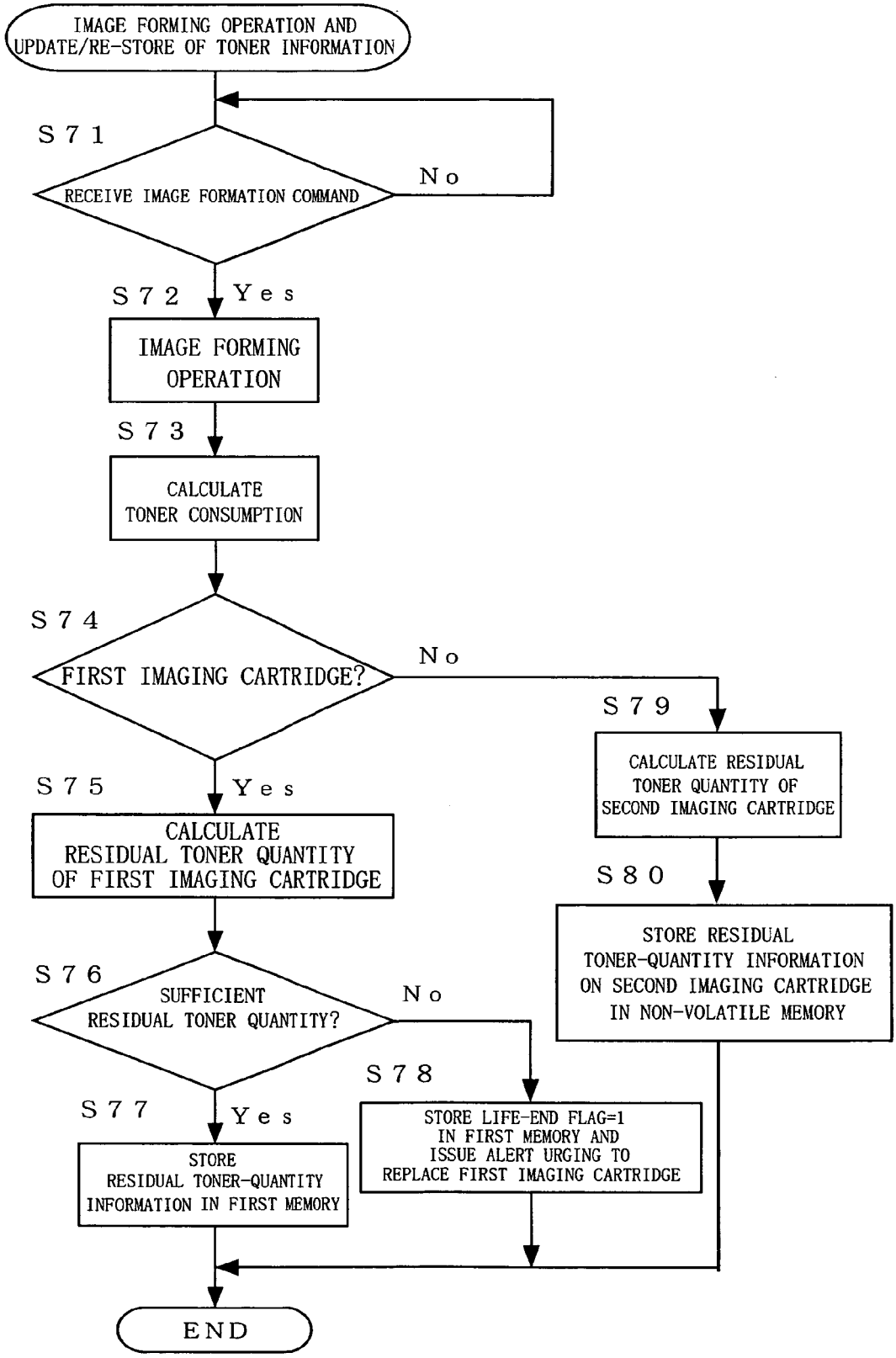
FIG. 6 is a flow chart showing the steps of a subroutine for performing an image forming operation and updating/re-storing toner information, the subroutine executed in the image forming apparatus according to the above embodiment.

Next, a subroutine for the image forming operation and the update/re-store of the toner information in Step S7 is described with reference to a flow chart shown in FIG. 6.

The image forming operation and the update/re-store of the toner information are performed as follows. When the apparatus receives an image formation command in Step S71, the operation flow proceeds to Step S72 to perform the image forming operation by using the individual imaging cartridges. In the subsequent Step S73, a toner consumption of each of the imaging cartridges is calculated.

In Step S74, determination is made as to whether the above imaging cartridge is the first imaging cartridge without the memory or not. In a case where the above imaging cartridge is the first imaging cartridge, the operation flow proceeds to Step S75 where a residual quantity of the toner in the first imaging cartridge is calculated based on a residual toner quantity stored in the first memory and the toner consumption calculated in Step S73.

Subsequently, whether the first imaging cartridge contains a sufficient quantity of residual toner or not is determined in Step S76. If the residual toner quantity is sufficient, residual toner-quantity information is updated with the present residual toner quantity and re-stored in the first memory in Step S77. If the residual toner quantity of the first imaging cartridge falls short, on the other hand, the operation flow proceeds to Step S78 where the life-end storing portion sets the life-end flag to 1, which is stored in the first memory. In the meantime, the alerting portion 24 issues an alert urging to replace the first imaging cartridge with a second imaging cartridge carrying a memory.

In a case where it is determined in Step S74 that the imaging cartridge in question is not the first imaging cartridge but the second imaging cartridge carrying the memory, the operation flow proceeds to Step S79 to calculate a residual quantity of the toner in the second imaging cartridge based on the residual toner quantity stored in the above memory and the toner consumption calculated in Step S73. In Step S80, the residual toner quantity of the second imaging cartridge is updated with the residual toner quantity thus calculated and is re-stored in the above memory.

The apparatus may be switched from the first management mode managing the first imaging cartridges by storing information related to the first imaging cartridges in the first memory provided in the apparatus body to the second management mode managing the second imaging cartridges by storing information related to the second imaging cartridges in the non-volatile memory carried by the second imaging cartridges, when the life-end flag of the first memory in the apparatus body is 1 (a determination by Step S21 is No) and loading of the second imaging cartridge is confirmed (a determination by Step S25 is Yes). After switched to the second management mode as mentioned above, the apparatus is never returned into the first management mode, and detection of an imaging cartridge and determination of the type of the imaging cartridge are performed in the second management mode.

Figure 4:
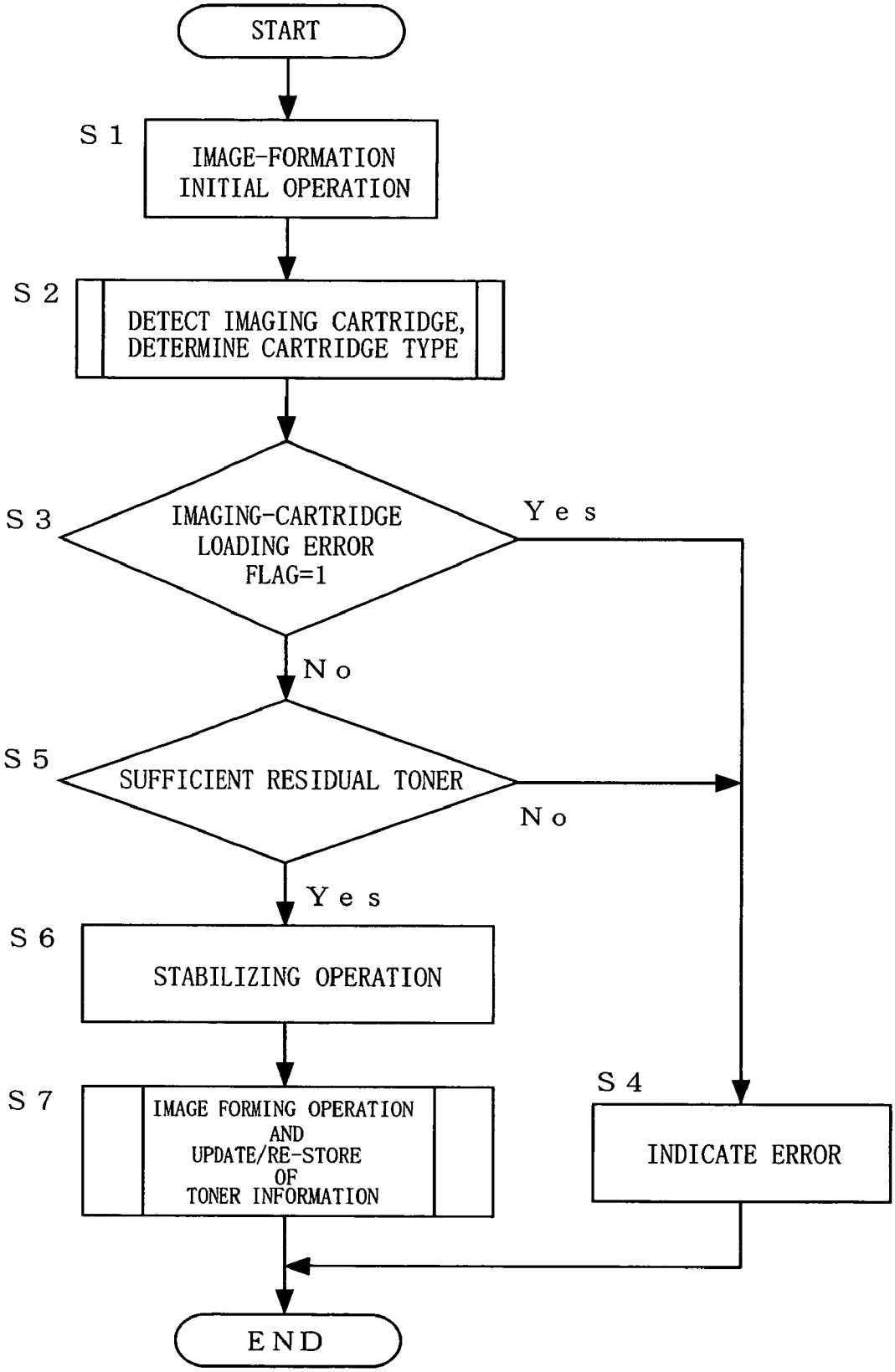
FIG. 4 is a flow chart showing the steps of a main operation preceding image formation performed by the image forming apparatus according to the above embodiment.

Further, it may be possible that the content of error indication of step S4 shown in FIG. 4 is different from each other in the first management mode and the second management mode. For example, it may be possible to indicate an error related to the first imaging cartridge in the first management mode and to indicate an error related to the second imaging cartridge in the second management mode. In such a constitution, the image forming apparatus of the present invention being capable of using the first imaging cartridge and the second imaging cartridge, whose management methods are different from each other, may provide an appropriate error indication with a user.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

The invention claimed is:

1. An image forming apparatus comprising:

a cartridge loading portion removably loaded with a first cartridge containing therein a consumable but carrying no memory storing information on the consumable, or with a second cartridge containing therein the consumable and carrying a memory storing information on the consumable;

a controller;

and a first memory for storing the information on the consumable contained in the first cartridge, wherein the controller includes:

a determination portion for determining whether a cartridge loaded in the cartridge loading portion is the first cartridge or the second cartridge;

a first consumption calculating/storing portion operating when the first cartridge is loaded in the cartridge loading portion, calculating a consumption of the consumable in the first cartridge and storing the calculation result in the first memory;

a life-end storing portion for detecting the life end of the first cartridge based on the consumable consumption of the first cartridge calculated by the first consumption calculating/storing portion, and for storing the life-end information on the first cartridge in the first memory; and a second consumption calculating/storing portion for calculating a consumption of the consumable in the second cartridge and storing the calculation result in the memory installed in the second cartridge.

2. An image forming apparatus according to claim 1, wherein the controller further includes an alerting portion for issuing an alert urging to replace the first cartridge, the life end of which is detected by the life-end storing portion, with the second cartridge.

3. An image forming apparatus according to claim 1, wherein the controller operates to switch the apparatus between a first management mode to manage the consumable consumption by means of the first consumption calculating/storing portion and a second management mode to manage the consumable consumption by means of the second consumption calculating/storing portion, and switches the apparatus from the first management mode to the second management mode when the life end of the first cartridge is detected by the life-end storing portion.

4. An image forming apparatus according to claim 3, wherein the controller further includes an image formation restricting portion for restricting image formation by means of the first cartridge when the apparatus is switched from the first management mode to the second management mode.

5. An image forming apparatus according to claim 1, which performs image formation based on image formation information stored in the first memory in a case where the first cartridge is loaded in the cartridge loading portion, and which performs the image formation based on image formation information stored in the memory installed in the second cartridge in a case where the second cartridge is loaded in the cartridge loading portion.

6. An image forming apparatus according to claim 1, which performs an image stabilization operation based on image formation information stored in the first memory in a case where the first cartridge is loaded in the cartridge loading portion, and which performs the image stabilization operation based on image formation information stored in the memory installed in the second cartridge in a case where the second cartridge is loaded in the cartridge loading portion.

7. An image forming apparatus according to claim 1, comprising a plurality of cartridge loading portions, wherein the first memory stores information corresponding to a cartridge loaded in each of the cartridge loading portions.

8. An image forming apparatus according to claim 7, wherein the plural cartridge loading portions are loaded with cartridges individually containing therein toners having mutually different colors, as the consumables.

9. An image forming apparatus according to claim 1, wherein the determination portion differentiates the first cartridge from the second cartridge based on whether the cartridge loaded in the cartridge loading portion has the memory or not, the memory storing the information on the consumable.

10. A control method for an image forming apparatus removably loaded with a cartridge containing therein a consumable, comprising:

a step of determining whether the loaded cartridge is a first cartridge containing therein a consumable but not carrying a memory storing information on the consumable or a second cartridge containing therein the consumable and carrying a memory storing information on the consumable;

step of calculating a consumption of the consumable in the first cartridge and storing the calculation result in a first memory provided in the image forming apparatus in a case where the loaded cartridge is the first cartridge;

a step of storing life-end information on the first cartridge in the first memory when the first cartridge is determined to reach its life end based on the consumable consumption of the first cartridge in the case where the loaded cartridge is the first cartridge; and a step of calculating a consumption of the consumable in the second cartridge and storing the calculation result in the memory installed in the second cartridge in a case where the loaded cartridge is the second cartridge.

11. A control method according to claim 10, further comprising a step of alerting a user to replace the first cartridge with the second cartridge when the first cartridge is determined to reach its life end.

12. A control method according to claim 10, further comprising:

a step of checking the first memory to determine whether the life-end information on the first cartridge is stored in the first memory or not;

a step of determining whether the loaded cartridge is the first cartridge or the second cartridge; and a step of restricting image formation in a case where the life-end information on the first cartridge is stored in the first memory and the first cartridge is loaded.

13. A control method according to claim 12, wherein the image formation is restricted in the case where the life-end information on the first cartridge is stored in the first memory and the first cartridge is loaded.

14. A control method according to claim 10, wherein image formation is performed based on image formation information stored in the first memory in a case where the first cartridge is loaded, and wherein the image formation is performed based on image formation information stored in the memory installed in the second cartridge in a case where the second cartridge is loaded.

15. A control method according to claim 10, wherein an image stabilization operation is performed based on image formation information stored in the first memory in a case where the first cartridge is loaded, and wherein the image stabilization operation is performed based on image formation information stored in the memory installed in the second cartridge in a case where the second cartridge is loaded.

16. A control method according to claim 10, wherein whether the cartridge loaded in a cartridge loading portion is the first cartridge or the second cartridge is determined based on whether or not the loaded cartridge carries the memory storing the information on the consumable.

* * * * *